US012398579B2

(12) United States Patent
Saltijeral et al.

(10) Patent No.: US 12,398,579 B2
(45) Date of Patent: Aug. 26, 2025

(54) SECURE TENSIONED PERIMETER BARRIER WITH TENSIONING MEANS AND METHOD OF CONSTRUCTION

(71) Applicant: Industrial Fence, Inc., Chicago, IL (US)

(72) Inventors: Miguel A. Saltijeral, Oswego, IL (US); David Saltijeral, Yorkville, IL (US); Noel Pruneda, Aurora, IL (US); Matthew C. Walz, Wheaton, IL (US)

(73) Assignee: INDUSTRIAL FENCE, INC., Chicago, IL (US)

( * ) Notice: Subject to any disclaimer, the term of this patent is extended or adjusted under 35 U.S.C. 154(b) by 646 days.

(21) Appl. No.: 17/696,962

(22) Filed: Mar. 17, 2022

(65) Prior Publication Data

US 2022/0298826 A1 Sep. 22, 2022

Related U.S. Application Data

(60) Provisional application No. 63/162,768, filed on Mar. 18, 2021.

(51) Int. Cl.
*E04H 17/04* (2006.01)
*E04H 17/06* (2006.01)
(Continued)

(52) U.S. Cl.
CPC ..... *E04H 17/05* (2021.01); *E04H 17/06* (2013.01); *E04H 17/124* (2021.01); *E04H 17/266* (2013.01)

(58) Field of Classification Search
CPC ..... E04H 17/02; E04H 17/05; E04H 17/06; E04H 17/063; E04H 17/066; E04H 17/10;
(Continued)

(56) References Cited

U.S. PATENT DOCUMENTS 967,691 A * 8/1910 Walther ..... E04H 17/124 256/51
1,083,848 A * 1/1914 McGee ..... E04H 17/124 256/49
(Continued)

FOREIGN PATENT DOCUMENTS

EP 0503952 A1 * 9/1992 ..... E04H 17/161
FR 2345571 A1 * 10/1977 ..... E04H 17/05
(Continued)

OTHER PUBLICATIONS

"Extruded 5/8"×5/8" Mini Mesh Chain Link". Chain Link Mini Mesh, Jun. 3, 2017, [online], [retreived on Oct. 9, 2024] Retreived from the Internet <URL:https://www.chainlinkminimesh.com/extruded/58-58-extruded-mini-mesh-fence.html>. (Year: 2017).*

*Primary Examiner* — Amber R Anderson
*Assistant Examiner* — Kevin J Baynes
(74) *Attorney, Agent, or Firm* — Advitam IP, LLC

(57) ABSTRACT

A tensioned barrier, comprising a chain link or mesh fence providing a secure perimeter, is provided. The fence is tensioned by grabbing and holding one end of the mesh link, wrapping the mesh around a perimeter of the fence poles, including wrapping the mesh around the outside of corner poles, pulling the mesh at its distal end to create a tension in the mesh and then grabbing the distal end of the mesh and securing it to the final fence pole. The fence is created using a high strength small weave mesh that resists cutting and climbing. In one embodiment the fence is created adjacent a structure, using the structure as an element of the barrier. In another embodiment, a fully fenced area is created by placing the first fence pole at a small distance apart from the final fence pole, with the other poles forming a perimeter, and tensioning and wrapping the mesh around all of the
(Continued)

poles, affixing the ends of the mesh to the first and final poles and providing a gate or door between the first and final poles.

18 Claims, 16 Drawing Sheets

(51) Int. Cl.
*E04H 17/10* (2006.01)
*E04H 17/26* (2006.01)

(58) Field of Classification Search
CPC ..... E04H 17/12; E04H 17/124; E04H 17/127; E04H 17/131; E04H 17/133; E04H 17/135; E04H 17/139; E04H 17/1413; E04H 17/161; E04H 17/20; E04H 17/23; E04H 17/24; E04H 17/26; E04H 17/261; E04H 17/266; E04H 17/268
USPC ..... 52/764, 774, 775
See application file for complete search history.

(56) References Cited

U.S. PATENT DOCUMENTS 1,243,884 A * 10/1917 Smith ..... E04H 17/124 256/52
1,979,866 A * 11/1934 Chapman ..... E04H 17/06 256/32
2,331,390 A * 10/1943 Gustafson ..... E04H 17/124 24/23 W
2,753,156 A * 7/1956 Rieger ..... E01F 7/02 256/34
2,940,466 A * 6/1960 Speights ..... F16L 1/0243 239/289
3,021,114 A * 2/1962 O'Connell ..... E04H 17/161 D25/45
3,021,116 A * 2/1962 Querengesser ..... E04H 17/1413 256/72
3,806,095 A * 4/1974 Ford ..... E04H 17/06 256/34
3,951,385 A * 4/1976 Folden ..... B21F 33/02 256/47
4,070,006 A * 1/1978 Storie ..... E04H 17/05 256/1
4,111,399 A * 9/1978 Hutchison, III ..... B21F 27/005 245/8
4,143,859 A * 3/1979 Tews ..... E04H 17/124 256/49
4,148,466 A * 4/1979 Wilson ..... E04H 17/127 256/47
4,261,557 A * 4/1981 Johnson ..... E04H 17/266 269/46
4,526,347 A * 7/1985 McLoughlin ..... E01F 13/022 256/33
4,576,364 A * 3/1986 O'Fearna ..... E04H 15/003 256/73
4,673,166 A * 6/1987 MacDougall ..... E04H 17/003 256/11
4,690,384 A * 9/1987 Palmer ..... E04H 17/124 256/32
4,899,990 A * 2/1990 Winders ..... E04H 17/124 174/173
5,110,094 A * 5/1992 Kruse ..... E04H 17/124 256/48
5,255,898 A * 10/1993 Cacicedo ..... E04H 17/124 256/48
5,556,080 A * 9/1996 Vise ..... E04H 17/161 256/22
6,176,471 B1 * 1/2001 Naegele ..... E04H 17/161 256/65.02
6,206,347 B1 * 3/2001 Kelley ..... E04H 17/24 256/48
6,367,781 B1 * 4/2002 Flynn ..... D04B 21/10 256/45
6,899,320 B1 * 5/2005 Wallace ..... B25B 25/00 254/222
6,959,919 B2 * 11/2005 Knott, Sr. ..... E04H 17/05 256/48
9,212,504 B1 * 12/2015 Mobile, Sr. ..... E04H 17/12
9,487,946 B2 * 11/2016 Bengtsson ..... E04C 3/20
9,777,447 B1 * 10/2017 Hipfl ..... E02D 3/005
11,008,774 B2 * 5/2021 Shi ..... E04H 17/124
11,629,522 B1 * 4/2023 Soto ..... E04H 17/266 256/37

FOREIGN PATENT DOCUMENTS

GB 262983 A * 12/1926 ..... E04H 17/124
WO WO-2009154356 A2 * 12/2009 ..... E04H 17/1408

* cited by examiner

SECURE TENSIONED PERIMETER BARRIER WITH TENSIONING MEANS AND METHOD OF CONSTRUCTION

RELATED APPLICATIONS

This application claims priority benefit of U.S. Provisional Patent Application Ser. No. 63/162,768, filed Mar. 18, 2021 titled: Chain Link Wrap Fence with Grab Bars, the contents of which is hereby incorporated by reference.

BACKGROUND OF THE INVENTION

Security has become paramount. From airports to sporting events and shopping malls all eyes are on the safety of citizens as individuals and groups, events and property. This extends as well to secured government and industrial facilities, military bases worldwide and international borders. Tasked with securing all manner of locations, government agencies, such as the United States Department of Homeland Security (DHS) have issued guidelines for all manner of security systems. Included in these guidelines are the guidance factors for protective fences and barriers used to contain important or targeted facilities and areas in the US and in areas where such facilities are located worldwide.

The first round of defense for a facility or border is a barrier, often in the form of a perimeter fence. Fences are useful in both keeping out unwanted visitors and as well keeping in those who should not be allowed out, within. While a four-foot-high chain link fence will keep the neighbor's dog out of your backyard, more significant structures with elements able to defeat unwanted egress are typically required in increasing levels of security at such places as factories, prisons, refugee encampments, military bases, government facilities and laboratories, embassies and consulates and housing for heads of state (it is noted that the order of the items listed here does not reflect a hierarchy of need).

Fences must be chosen with skill to fit the requirements, their location and the items or subjects to be protected. A factory in a major US city is more likely in need of protection to keep thieves and spray paint taggers out; as opposed to an embassy, located in a country having unrest, where the barrier fence is likely to be necessary for the avoidance of, at a minimum, an international incident and/or, in the worst case, an act of war. A nuclear test facility is likely to be more concerned with the ingress of spies, whereas a prison in a suburb of Chicago is more likely to be concerned with the escape of an inmate. A fence surrounding an airport is designed to protect those on the outside from contact with aircraft, while also perfecting the level of security for passengers and equipment by stopping unauthorized entry into the airfield and/or unauthorized persons entering aircraft from without.

But contrastingly, once an intruder is in, for example, a nuclear facility there is also interest in making sure such an intruder cannot leave; a prison warden would not want an assault on his fence from outside that would allow inmates to flee, a military base or government facility, in a foreign land, depends on the fence to keep its personnel both within and safe and unauthorized persons out.

Further, in the event of a change in situation, such as the deterioration of foreign relations with a nation in which a facility is located, or a radical change in government, it would be helpful if whatever barrier means is presently in situ could be quickly fortified or replaced by a more formidable barrier.

Fence materials are typically lighter weight and less costly to install than walls and their use is typically made such that the facility behind the fence is not obscured but is visible through the fence, making for a more pleasant landscape as well, allowing what is without the fence to be viewed from within and vice-versa, for security reasons. There are, therefore, various degrees of fence protection, ranging from a wooden picket fence, which is primarily decorative or used to mark a boundary, to wooden stockade fences designed to either keep things out or in—protecting small parcels of land, maintaining privacy; to chain link fences with various measures to support their barrier, including various heights of fence, and as well sharpened elements and/or electrification to keep persons from climbing in a spectrum of minimal to greater protection. Beyond chain-link, the use of metal (such as steel), concrete or stone structures, about a perimeter, is more akin to a wall and maybe beyond the scope of the present invention.

Additionally, the traditional method of building a fence or barrier is to set posts at required distances, and then assemble the fence in situ—by assembling, typically with fasteners or welding, fence rails, support members, bars, chain link or other mesh products and gates. The mesh typically being added between end fence posts or poles, with the end poles typically being exposed within and outside of the fence. Such a system is time consuming to assemble and the time it takes to assemble can expose the contractor to dangers during constructions, depending on the location where the fence is placed; for example, in or near a war zone or on a boarder with a hostile nation. Time can be of the essence in creating such fences, and the typical methods of assembly-in-place can consume enormous amounts of time and resources and typically the fence or barrier, and what it protects or will protect, is at risk throughout the assembly process. The assembly time can also be costly in man-hours, which may be charged at an hourly premium, such as combat pay, due to adverse conditions existing during installation.

Typically, however, fences and barriers are costly, at any level, and take time, for example, to secure permits, design and installation; further, changing to another form of fence or barrier as may be required, can be difficult, costly and time consuming.

Existing fencing solution processes do not provide an efficient or effective process because existing processes are designed with many separate fasteners to secure the chain link fencing, especially at the posts. The problem with this method is that the fasteners are exposed to the outer perimeter that makes it more readily accessible for perpetrators to breach by partial disassembly of such fences to create openings therein.

Accordingly, the present invention is directed to be an improved chain link fence security barrier. The chain link fencing solution of the assignee of the present invention, Industrial Fence, Inc. of Chicago, Illinois, includes the strongest chain link materials on the market, and it provides a cost-effective and corrosion resistant product that is 9 to 13 times stronger and longer lasting than standard chain link fencing. The present invention is IKE certified, a certification by the Physical Security Division at vScenario LLC. of Chicago, Illinois (vscenario.com), using a proprietary physical security assessment tool, and has withstood numerous trials that test the durability of the chain link and the speed at which highly trained military personnel are able to breach the perimeter. In testing, it was found that the 6-gauge, ⅝" embodiment of the chain link system resulted in 13 times increased difficulty of breach when compared to standard chain link; the 9-gauge, ⅜" embodiment of the chain link system resulted in a 9-times increased difficult to breach when compared to standard chain link.

It is apparent that a need exists for a fence system that improves on standard chain link solutions, especially in circumstances that require increased security protocols. The present invention, accordingly, provides a chain link fence having two set terminal posts that connect a sheet of chain link weave together, without the need for additional fasteners. The present invention is directed toward providing such a solution by eliminating all or most fasteners on terminal posts, eliminating exposed fasteners, bracers, or brackets, and making it extremely difficult to climb and/or cut through.

One benefit of eliminating access to fasteners to persons located outside of the fence is to maximize restricted access. Without having physical ability to access or reach these fasteners, a person cannot tamper with the barrier thereby enhancing overall security. Another benefit of restricting access to the fasteners is improving the speed and quality of installation. Additionally, as opposed to other products available on the market, the present invention does not require any or only minimal in number of typical fencing brackets, hangers, straps, or bands, thereby further enhancing security and increasing the speed and facility of installation.

A primary use of the present invention is for increased security protocol. The chain link barrier systems can be installed for use at airports, military grade locations, embassies, oil and gas stations, corrections facilities, data centers, power and energy plants, utility plants, factory and manufacturing locations, and other locations that require top grade security systems. Specifically, the present invention is directed to security barrier systems for preventing trespass onto government sites and private or commercial properties.

It is therefore desirable to protect all of the aforementioned facilities, and others, with barriers made of fence materials, as opposed to walls, of the variety and security individually appurtenant to such facility. It is also desirable to be able to upgrade the protection as the threat or need arises. It is desirable to be able to place a fence in a location quickly and with strength to secure a facility or location in as little time and as economically as possible.

It is an object of the present invention to provide a means for more quickly installing a level of barrier protection appropriate to the facility and threat present and then to quickly upgrade or remove and replace such a barrier with a more secure perimeter. Further, the reduction of threat raises the concomitant issue of quickly reducing an imposing barrier with a more friendly barrier should a threat diminish or diplomacy call for a more open appearance.

It is an object of the invention to provide a quickly assemblable chain link fence providing a secure perimeter and including means to grab and hold the proximal end of a chain link mesh around a first fence post, wrapping the mesh around a perimeter of other fence posts, including wrapping the mesh around the corner post(s), tensioning the mesh at its distal end and then grabbing the distal end of the mesh and securing it to the final fence post. It is imagined that the first post or pole will be adjacent to a section of wall of a structure and the last post or pole will be adjacent to another section of wall of the structure and the fence will extend from the first pole to the last pole about a desired perimeter to form, with the structure, a closed barrier.

It is a further object to create such a barrier with a high strength small weave mesh that resists cutting and climbing. The basic barrier created by the present invention comprises a barrier without opening and would typically run from a first wall position to a second wall position of a structure for which an adjacent area requires protection. In another embodiment, the barrier includes a first fence post or pole at a close distance from the final fence post, such that the barrier mesh forms a full enclosure and a door or gate is placed between the first and final fence posts.

Another object of the invention, is to provide the described barrier during a period when the barrier is necessary and then removing the mesh element of the barrier, leaving the post in place, such that a sensation of openness is restored, with the capability of the mesh being replaceable quickly should security once again be necessary. It is also envisioned that high strength close weave mesh can be quickly replaced with standard chain link mesh at times when security is not enhanced, to provide a friendlier, less menacing look to facilities.

Other objects and advantages of the present invention will become apparent as the description proceeds.

While the present invention is susceptible of embodiments in various forms, there is shown in the drawings and will hereinafter be described some exemplary and non-limiting embodiments, with the understanding that the present disclosure is to be considered an exemplification for the invention and is not intended to limit the invention to the specific embodiments illustrated. In this disclosure, the use of the disjunctive is intended to include the conjunctive. The use of the definite article or indefinite article is not intended to indicate cardinality. In particular, a reference to "the" object or "a" object is intended to denote also one of a possible plurality of such objects.

SUMMARY OF THE INVENTION

In accordance with the present invention, an enhanced security fence is provided having a plurality of line posts or poles, corner posts or poles as needed, a plurality of terminal posts or poles set at the beginning and end of the perimeter, a plurality of rails, comprising a top, middle, and bottom rail, a plurality of high shear/strength aircraft rivets or similar strength means, a pair of proprietary grab bars welded into the terminal posts, a length of chain link mesh weave, and means to permit the chain link to engage the plurality of posts or poles, in at least a friction tensioned fit, with no exposed fastening members, to form a fence. In a preferred embodiment, the chain link mesh weave is a 9-gauge, ⅜" combination. In a separate alternate embodiment, the chain link mesh weave is a 6-gauge, ⅝" combination. To create the beginning and ending to the perimeter, posts are set into concrete or affixed to the target building in a pattern outlining the desired location of the barrier. The chain link mesh is then tensioned about the perimeter created by the posts/poles and attached to grab bars that, in a preferred embodiment, are welded to the terminal posts.

In a several embodiments of the present invention a secure tensioned perimeter barrier is provided, comprising at least two poles, each pole being affixed to a surface to be protected. A first grab bar is affixed to one of the at least two poles and a second grab bar affixed to another of the at least two poles. The barrier includes a length of mesh fabric and a tensioning device, for use in the assembly. The length of mesh fabric is wrapped about one of the at least two poles and held by the first grab bar thereon, the mesh is extended to the other of the at least two poles, having a grab bar affixed thereto, and the mesh is then tensioned, with the tensioning device, and then wrapped about the other of the at least two poles and attached to the second grab bar to form a tensioned barrier. In such embodiments, the grab bars include holding means; the holding means being activated to hold the mesh against the at least two poles to prevent removal of the mesh. In some embodiments of the present invention the holding means are extended metal rods that can be bent once employed on mesh, to enhance the hold thereof.

The barrier can be created using certain refinements such as the holding means being high strength rivets; and the mesh being made of a 9-gauge, ⅜" mesh weave, or a 6-gauge, ⅝" mesh weave. It will be understood, in line with the objectives of the present invention as expressed above, a barrier can be made using a lesser gauge of mesh material, such as those typically used around houses to, for example, keep the dog within, and then quickly changed, by means of the present invention, to have the higher strength mesh as those more specifically disclosed above.

In a preferred embodiment the at least two poles include two terminal poles, a plurality of line poles and corner poles, all affixed to a surface to form a perimeter needing protection. The length of mesh fabric is sufficient to span from one of the at least two poles to the other of the at least two poles while fully encompassing the at least two poles within the length mesh fabrics. Additionally, in some embodiments, a plurality of generally horizontal bars are affixed between the plurality of poles and the length of mesh fabric is affixed to the plurality of generally horizontal bars using ties.

The present invention provides a method of making a secure tensioned perimeter barrier including the steps of providing a plurality of poles, a length of mesh fabric and at least two mesh-to-pole affixing means, assembling the at least two mesh-to-pole affixing means to two of the plurality of poles to create a first terminal pole and a second terminal pole, and affixing the plurality of poles to a surface to be protected. The method includes attaching the proximal end of the length of mesh fabric to the mesh-to-pole affixing means of the first terminal pole, wrapping the length of mesh fabric about the first terminal pole to encase the first terminal pole therewithin the mesh fabric and extending the length of fabric to the second terminal pole and drawing on the distal end of the length of mesh fabric to provide tension therewithin the mesh fabric, wrapping the distal end of the mesh fabric about the second terminal pole to encase the second terminal therewithin the mesh fabric and attaching the distal end of the length of mesh fabric to the mesh-to-pole affixing means of the second terminal pole.

In some embodiments, the method of making a secure tensioned perimeter barrier of claim includes providing terminal poles, corner poles and line poles. In a preferred embodiment, a plurality of horizontal bars are affixed between the plurality of poles and a smaller plurality of the horizontal bars being tied to the mesh fabric. In the preferred embodiment the plurality of poles include two terminal poles, two corner poles and a plurality of line poles generally spaced between the corner poles. In such embodiments the terminal poles are placed adjacent a building structure and the plurality of poles are affixed to a surface, spaced apart, to define a perimeter on the surface to be protected. The plurality of poles include terminal poles, corner poles and line poles and the mesh is one of a 9-gauge, ⅜" mesh weave, and a 6-gauge, ⅝" mesh weave.

In some embodiments, the at least two mesh-to-pole affixing means are grab bars with metal rods extending generally perpendicularly therefrom, the metal rods being adapted to catch openings in the mesh fabric to hold the mesh fabric thereon. When the mesh fabric is caught by the extended metal rods, the metal rods are flattened against the grab bars to retain the mesh fabric thereon.

The present invention, in one form, features welded grab bars facing the interior of the secured perimeter. The welded grab bars have teeth elements, such as high shear/strength rivets, or other means for engaging, that emerge perpendicular to the surface of the grab bar and act as extensions onto which elements of the chain link can be attached to hold the chain link to the terminal posts/poles. This method, of grabbing the tensioned mesh and holding it on the terminal poles, allows for simple installation and allows the user to fold the teeth over the mesh, to thereby better secure the chain link mesh to the fence. The line posts are attached together with generally horizontal rails across the top, middle, and bottom sections. Additional structural integrity is created by attachment of the mesh to any one or more of the generally horizontal rails using a twist type fastener. An enhanced security fence then is made of a plurality of posts and a tensioned mesh chain link.

It will be understood that at such time as the need for security ends and the removal of the mesh of the present invention is desired, the user will straighten the teeth element, using means known to persons having ordinary skill in the art, and pull the mesh off of the grab bar at both ends of the barrier. High shear/strength rivets are described herein as a preferred product for this use because of their ability to be bent and straightened, numerous times, without breaking due to fatigue (as common rivets would). Persons having ordinary skill in the art will understand that the eventual replacement of the teeth, after numerous on-off cycles, may be necessary, such that the old rivets can be removed or cut down to the surface of the grab bars and new rivets then welded into place, during times when the mesh of the barrier is removed due to a lack of a need for such security. While the barrier has the mesh in place, the high shear/strength rivets will keep their integrity along with the rest of the fence materials.

A more detailed explanation of the invention is provided in the following description and claims and is illustrated in the accompanying drawings.

DETAILED DESCRIPTION OF THE ILLUSTRATIVE EMBODIMENT

Figure 1:
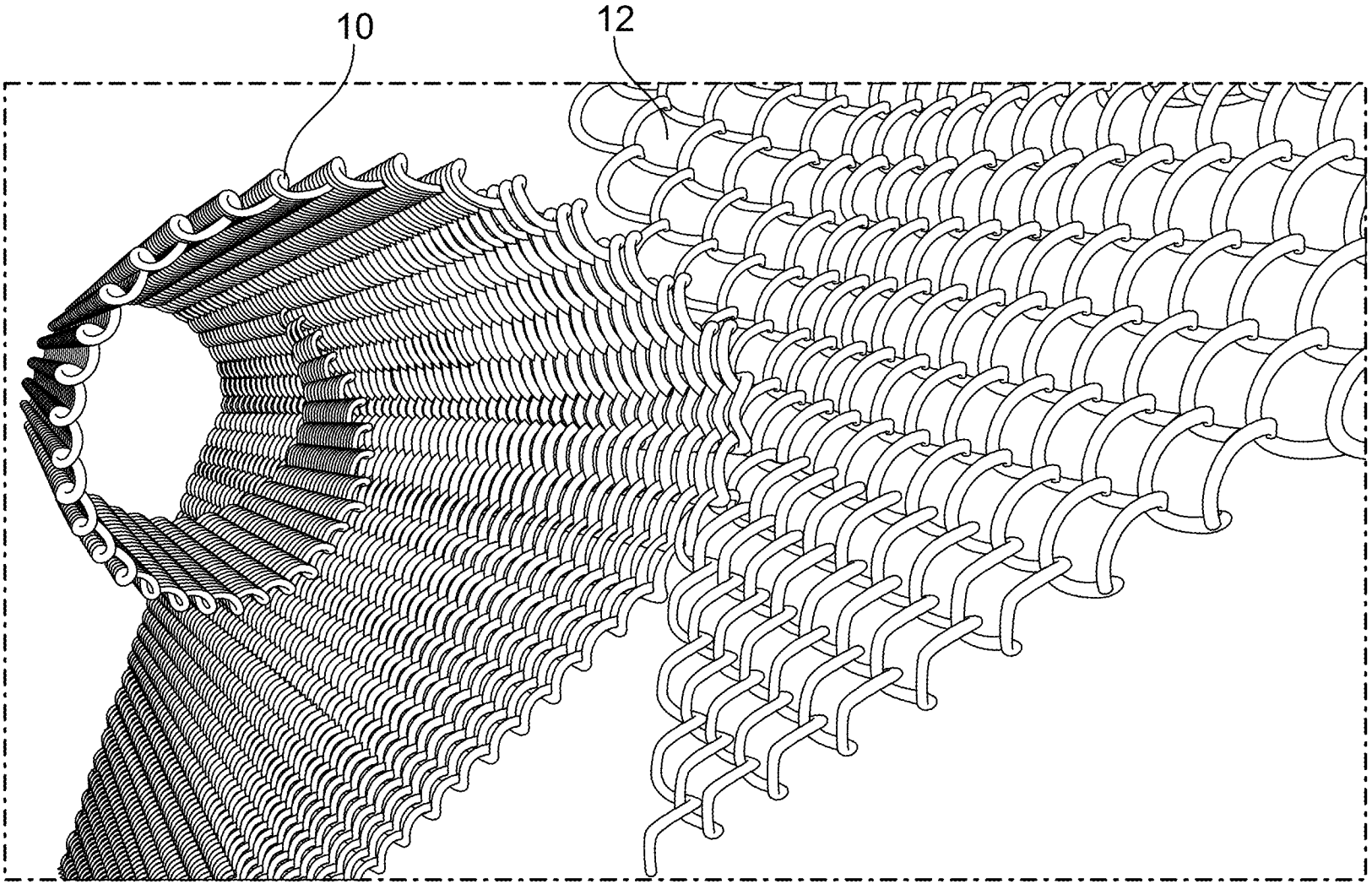
FIG. 1 is an enhanced view of the 9-gauge, ⅜" mesh weave and 6-gauge, ⅝" mesh weave.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of the Illustrative Embodiment") relates to a requirement of the United States Patent Office, and should not be found to limit the subject matter disclosed herein. It will be understood, by persons having ordinary skill in the art, that all of the elements shown and described and elements of the fences shown and described can be made from various materials, comprising metals and alloys, to prescribed strengths for various uses of the fences shown, without departing from the novel scope of the present invention. The use of many diverse materials is anticipated in the present invention to accommodate price, availability of materials, strength and weight characteristics and ease of manufacture and installation.

Figure 2:
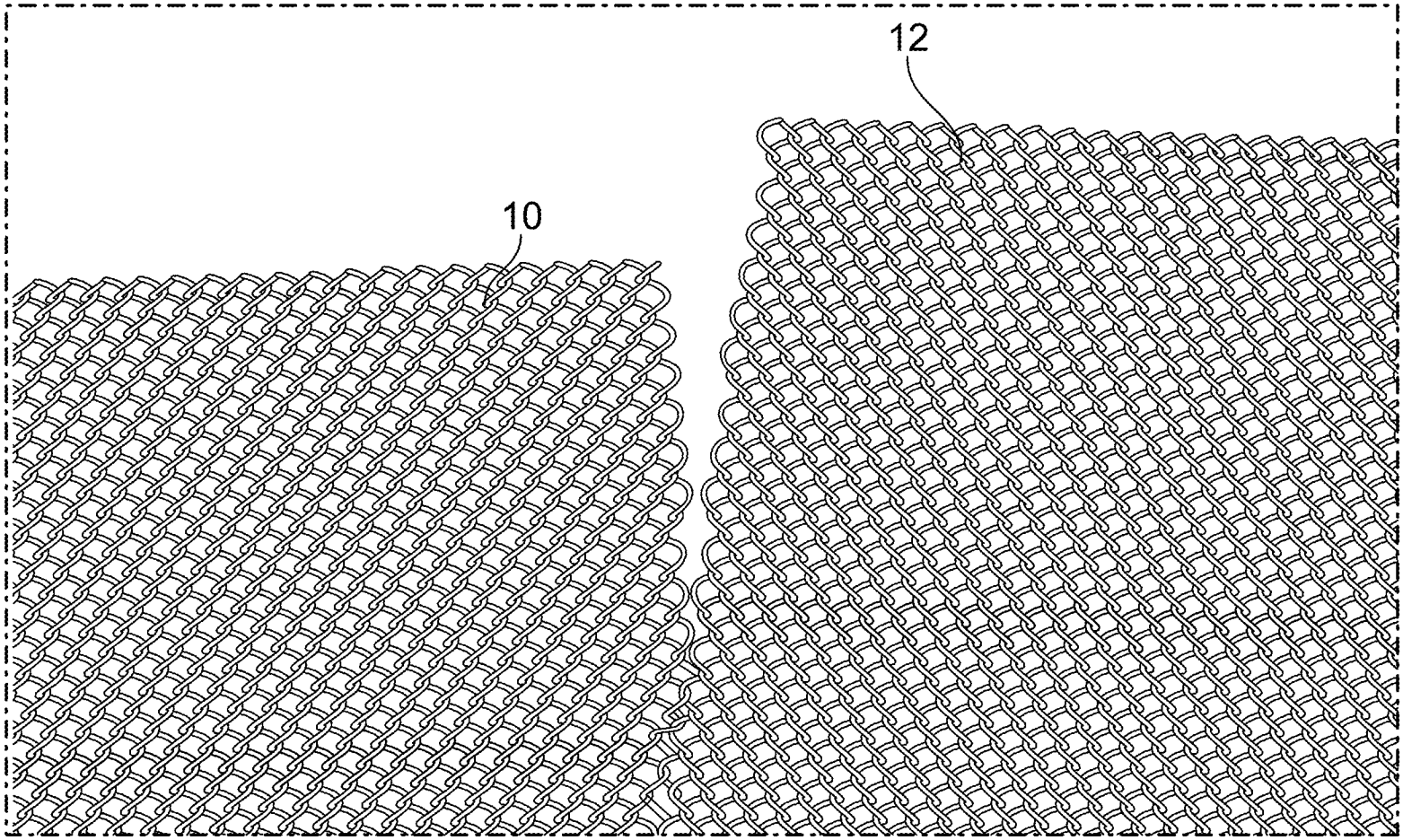
FIG. 2 is a side-by-side comparison of the 9-gauge, ⅜" mesh weave and 6-gauge, ⅝" mesh weave.

The main barrier element of a fence of this type is chiefly a high strength metal mesh, including chain link style mesh, but of course the present invention is not limited to chain fencing and can include other types of tensionable barrier materials, as will be understood by persons having ordinary skill in the art. As chain link is a substantial and generally affordable barrier product, it will be exemplified herein as a preferred material for the barriers of the present invention. Referring to the drawings, FIGS. 1 and 2 show examples of chain link fence or mesh 10, 12 used in barriers of the present invention. It will be understood that different types of mesh or link can be used to create the barriers described herein, without departing from the novel scope of the present invention. FIG. 1 illustrates the contrast in density between different mesh products; mesh 10, being a 9-gauge, ⅜" mesh weave, and mesh 12, being a6-gauge, ⅝" mesh weave as two potential materials to be used in a barrier or fence of the type noted herein. It will be understood by persons having ordinary skill in the art that mesh 10 and mesh 12 stand interchangeable and each would provide a perimeter defense for whatever is desired to be kept within or without an enclosure using these elements. Persons having ordinary skill in the art will understand that a tighter mesh would be more prohibitive to climbing such a fence, or barrier, restricting the entry of a shoe into the mesh and thereby prohibiting climbing; a larger gauge chain would tend to be more difficult to defeat by cutting. Therefore, the tighter the mesh and the larger the gauge of material, the more impenetrable the barrier and the more material being used to create the barrier. It will also be understood that the costs of such a barrier increases with the increase in materials. Persons having ordinary skill in the art will understand that various coatings can be added to the materials to protect the materials from damaging each other when abrasion between elements occurs, as will be discussed below, and keeps the barrier safe from the elements, looking new and more elegant. Further, as noted before, such a barrier can be created with a lesser gauge and greater sized opening and then, using the method described herein, the mesh can be quickly removed and replaced with the stronger harder to climb mesh to increase the security thereof, during times of increased danger. The subtle change in the strength of the chain may even serve to confuse potential infiltrators who will not note the change and may also be pleasing to the neighboring community as it will appear that the perimeter has not been increased in security so as not to alarm the public.

Figure 3:
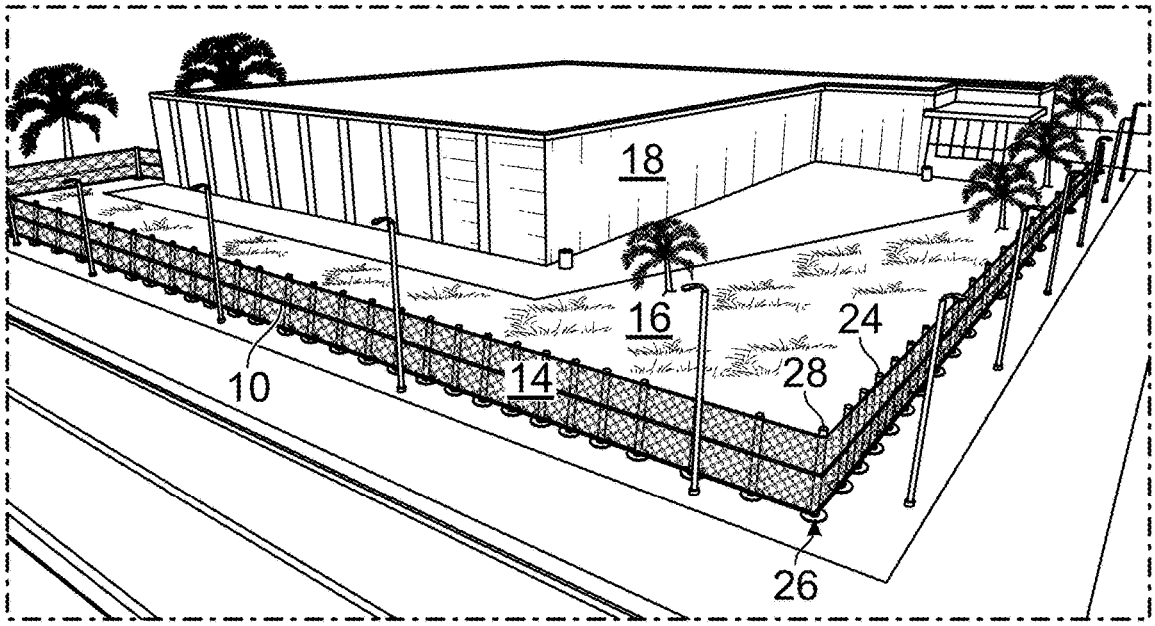
FIG. 3 is an elevational view of one embodiment of the fence perimeter after installation.
Figure 4:
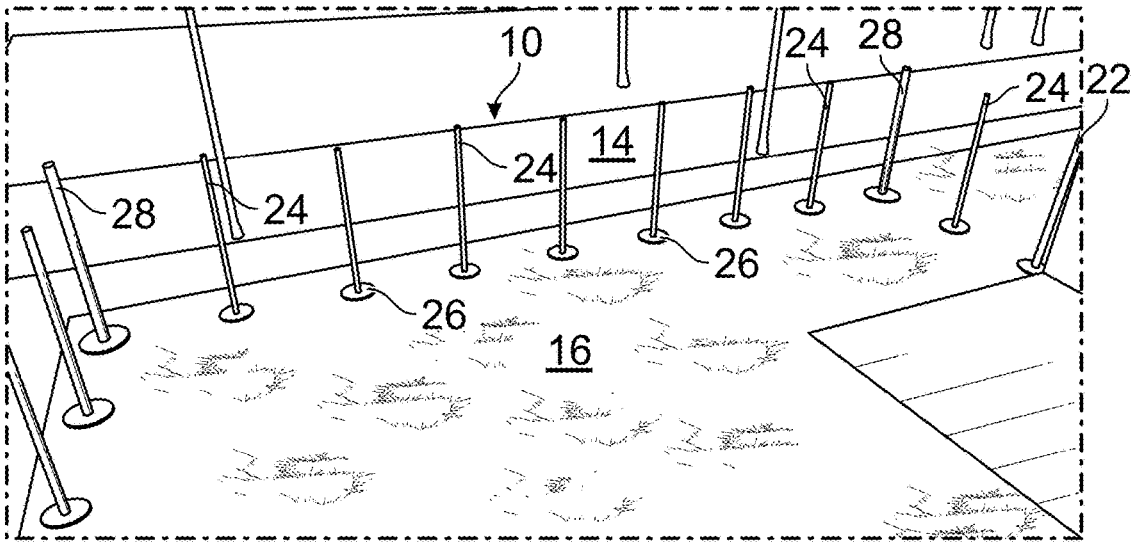
FIG. 4 is an elevational view of a section of the fence perimeter shown without the chain link.

As will be seen, in several of the drawing figures included herewith, and particularly in FIG. 3, a barrier 14 exists about a yard 16 and protected structure 18. The barrier 14 is created using a length of mesh 10, 12, generally equivalent in length to the entire perimeter of the barrier 14, along with perimeter poles 24, corner poles 28 and end poles 22 (as seen in FIG. 4); all poles being set into yard 16 by insertion into the ground and pouring concrete 26 to affix the poles therewithin, all in a manner known to persons having ordinary skill in the art. In the description herein, the terms "posts" and "poles" are considered interchangeable and should be understood to describe the generally vertical fence elements that tie the present invention to a surface and provide sufficient strength for the tensioned perimeter.

Figure 5:
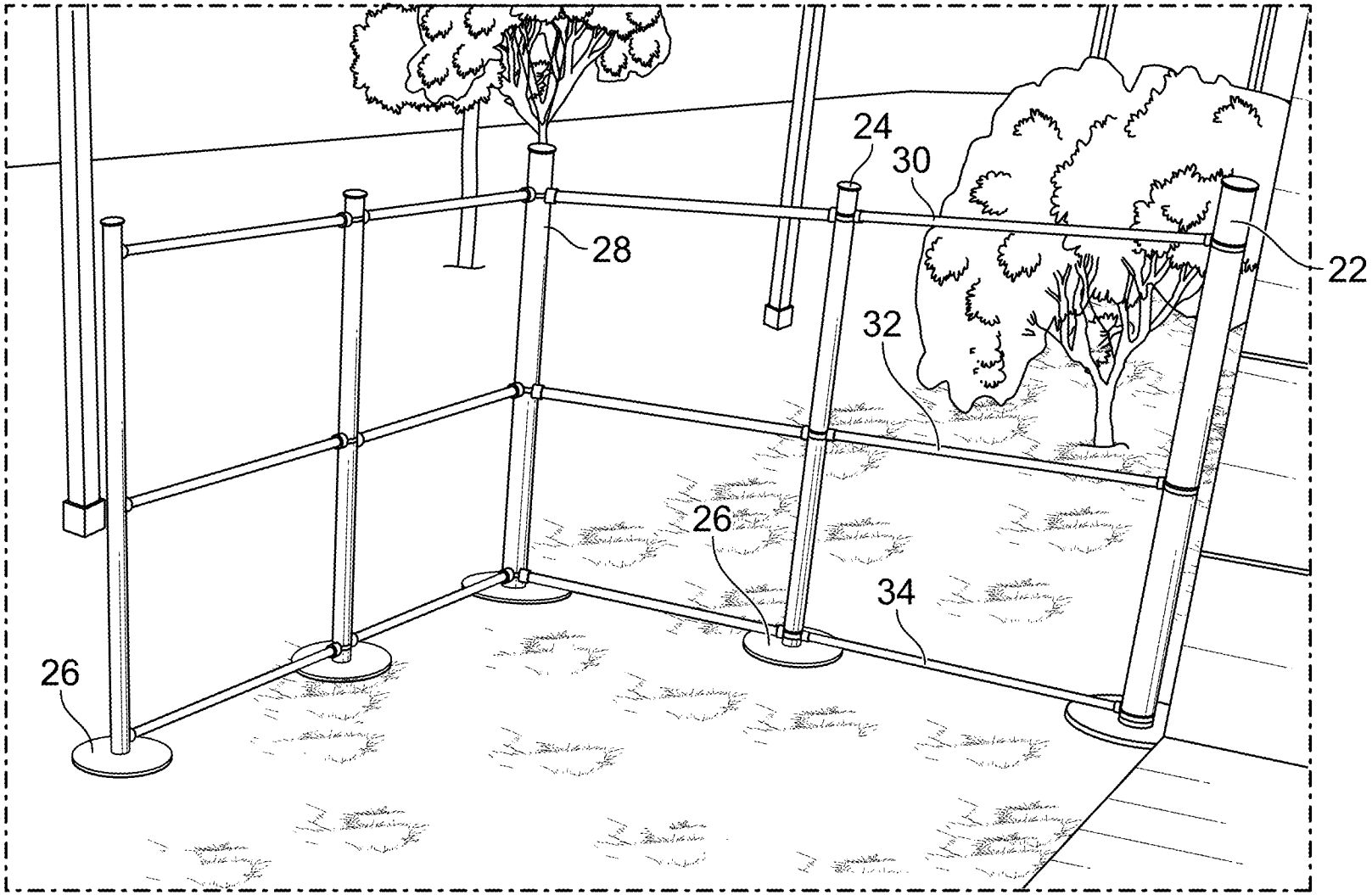
FIG. 5 is a cross-sectional view of the perimeter fence line posts and rails, forming the supporting framework of the perimeter.
Figure 13:
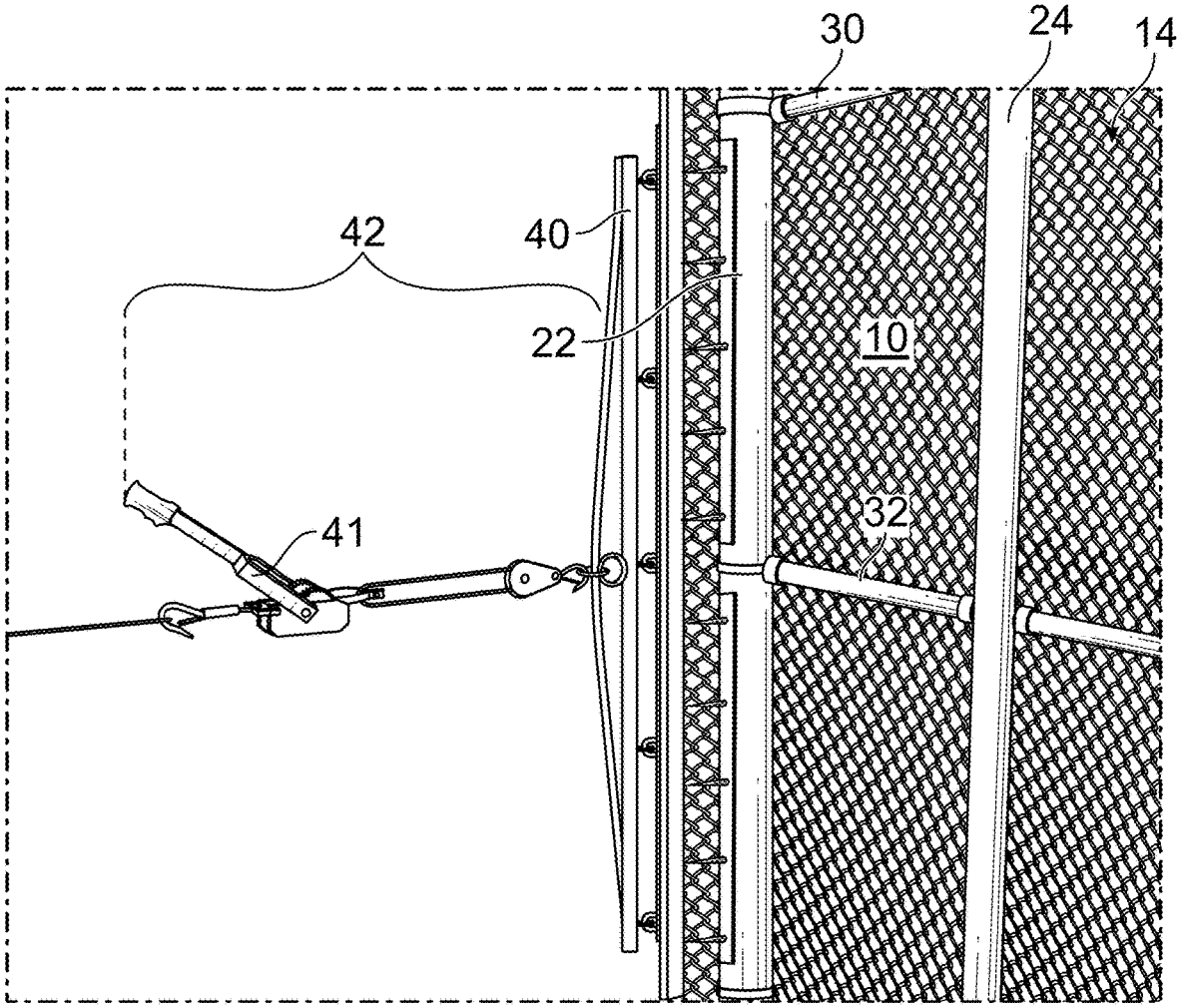
FIG. 13 is a perspective view of the terminal post with a fence tensioning tool, such as a come-a-long or pulley system attached to the tension bar clamped to the chain link mesh weave.
Figure 14:
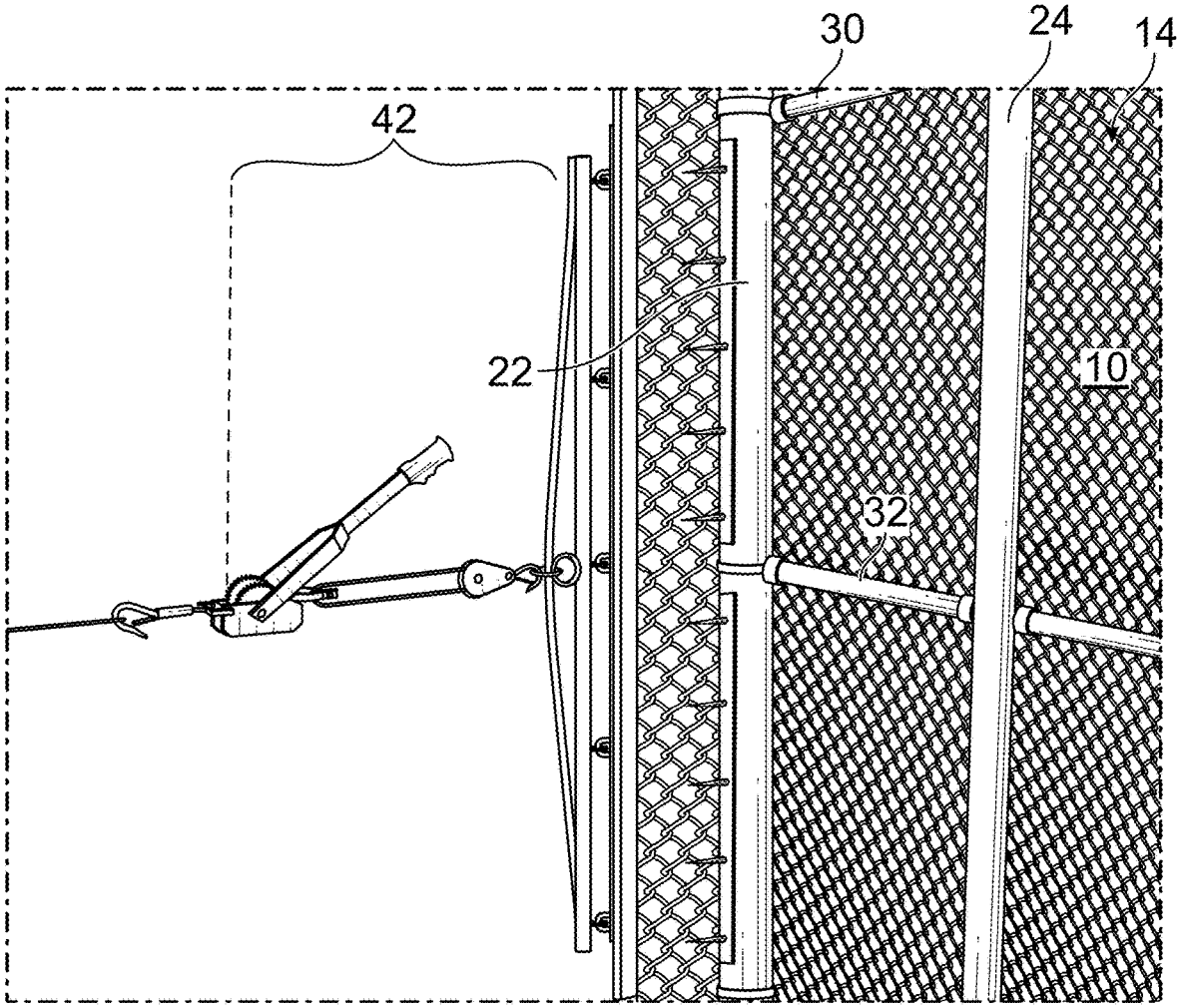
FIG. 14 is a view depicting how the fence tensioning pulley system tightens the chain link fence.

The first step in installation is the setting of the terminal or end poles 22, corner poles 28 and line or perimeter poles 24 into concrete pads 26. Openings in the ground 16 are made and the poles are set therein while concrete is poured therein to create pad 26, in a manner known to persons having ordinary skill in the art. The poles are placed at specified spacing to achieve a desired perimeter and concomitantly support level as well as a designed wind load strength, as shown in FIGS. 3-5. The designed wind load can be achieved by utilizing the fence tensioning tool in the form of a pulley system 40 or a come-a-long tool 42 as shown in FIGS. 13-14 and as will be explained in greater detail below.

Figure 6:
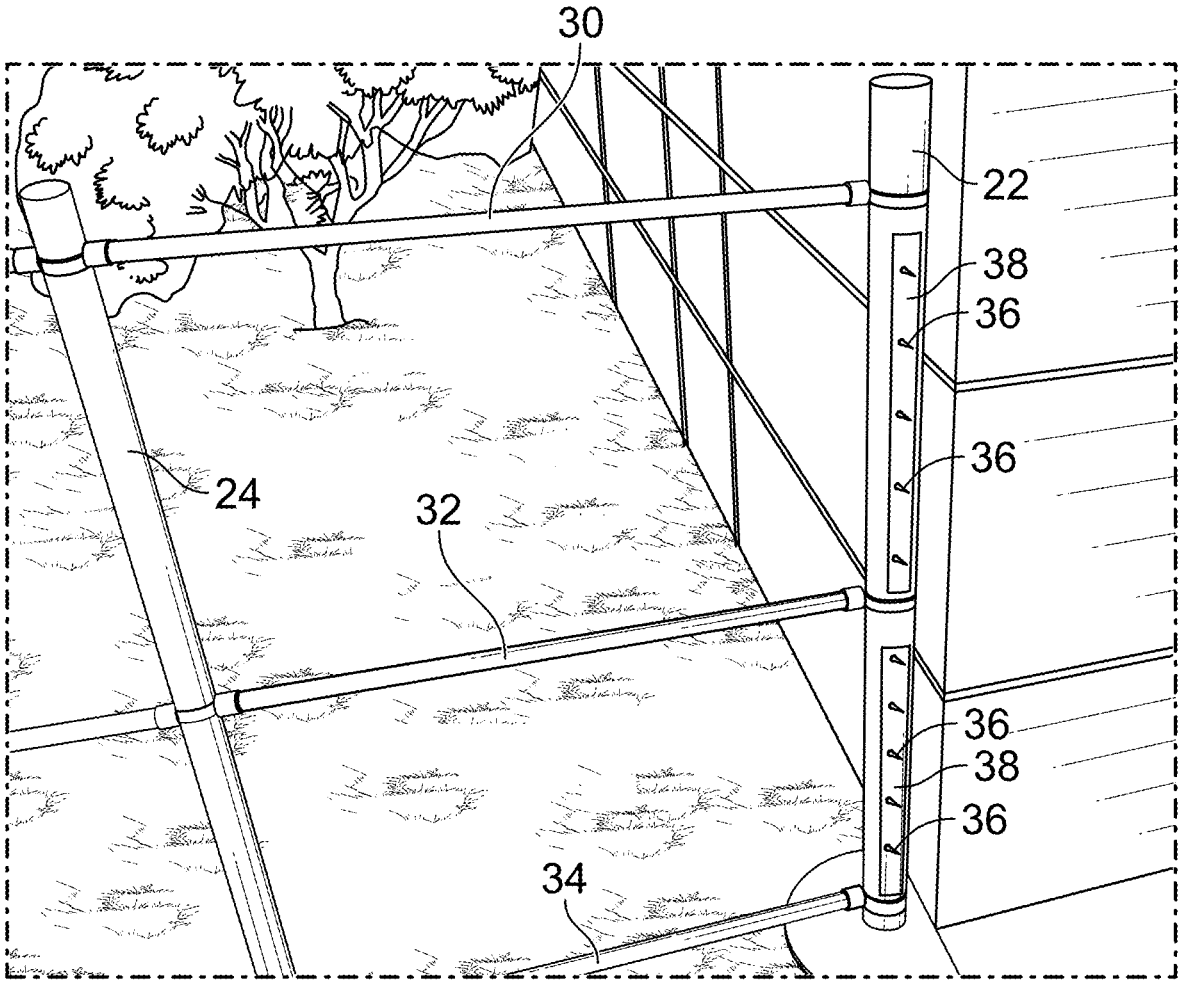
FIG. 6 is a view of the perimeter fence, featuring the terminal post and grab bars.

The perimeter fence 14 is further constructed of top rails 30, middle rails 32, and bottom rails 34 between the poles as shown in FIGS. 5-6. Persons having ordinary skill in the art will understand that the placement of the rails 30, 32 and 34 is done to afford the greatest strength and stability for mesh 10 or 12 and to better tie the mesh and supporting structure together. It will be understood, by persons having ordinary skill in the art, that other arrangements of the rails 30, 32 and 34, using more or fewer rails, and/or placing them in different relative positions to the height of the poles, is contemplated in the present invention. Placement of the poles can be varied, from the illustrations, in order to accommodate such things as portals or doorways in desired locations, features of the landscape and or to offer a fence structure, for example with more rails, to provide greater strength at specific locations. Openings in the fence would require additional support in light of the tension created in the placement of the mesh as will be discussed below in relation for FIG. 17. It will be understood that the drawings and description are for illustrative purposes and are not meant to be limitations on the numerous variations in the placement of elements in a fence.

Referring to FIG. 6, a proprietary grab bar 38 is affixed to the starting terminal pole 22 using such means as welding, adhesive or the fabrication of such a bar along with the pole, and other ways known to persons having ordinary skill in the art. In another embodiment of the invention, the proprietary grab bar 38 may be affixed via high strength aircraft-type rivets or can be attached using strong adhesives as is known to persons having ordinary skill in the art. Additionally, the proprietary grab bar 38 includes elongated high shear/strength aircraft-type rivets or similar high strength rolled or formed steel elements 36 welded, or otherwise affixed to grab bar 38. Grab bar 38 with rivets 36 is a simple adaption of the invention that permits the easiest manner of construction. As will be explained in more detail below, in use the mesh 10, 12 is wrapped upon the grab bar 38 such that the rivets 36 extend through the mesh 10, 12; the rivets are then knocked down flat against the mesh 10, 12 to capture the mesh against grab bar 36 on terminal pole 22, thereby holding the mesh in place. In this way, and upon tensioning as will be explained below, the mesh 10, 12 is held tight to the poles, 22, 24, 28 creating a strong, tensioned barrier with no need for means to fasten the mesh 10, 12 to the intermediate members of the barrier 14. Almost immediately a barrier 14 is created. Extra fastening can be provided, if desired, by using metal ties 33 to hold mesh 10, 12 against central rails 32. It will be understood that a grab bar 28 having mechanical means to extend and close hook elements, using a lever or switch, could be used on such a fence, without departing from the novel scope of the present invention. Such a system would add costs and complexity to the system but would be useful in situations where the chronic removal of mesh 10, 12 is required or desired. It will be understood that using such a retractable holding means would remove the element of fatigue of metal that can occur with the repeated movement needed to attach and then remove the mesh 10, 12 from the barrier elements.

Figure 7:
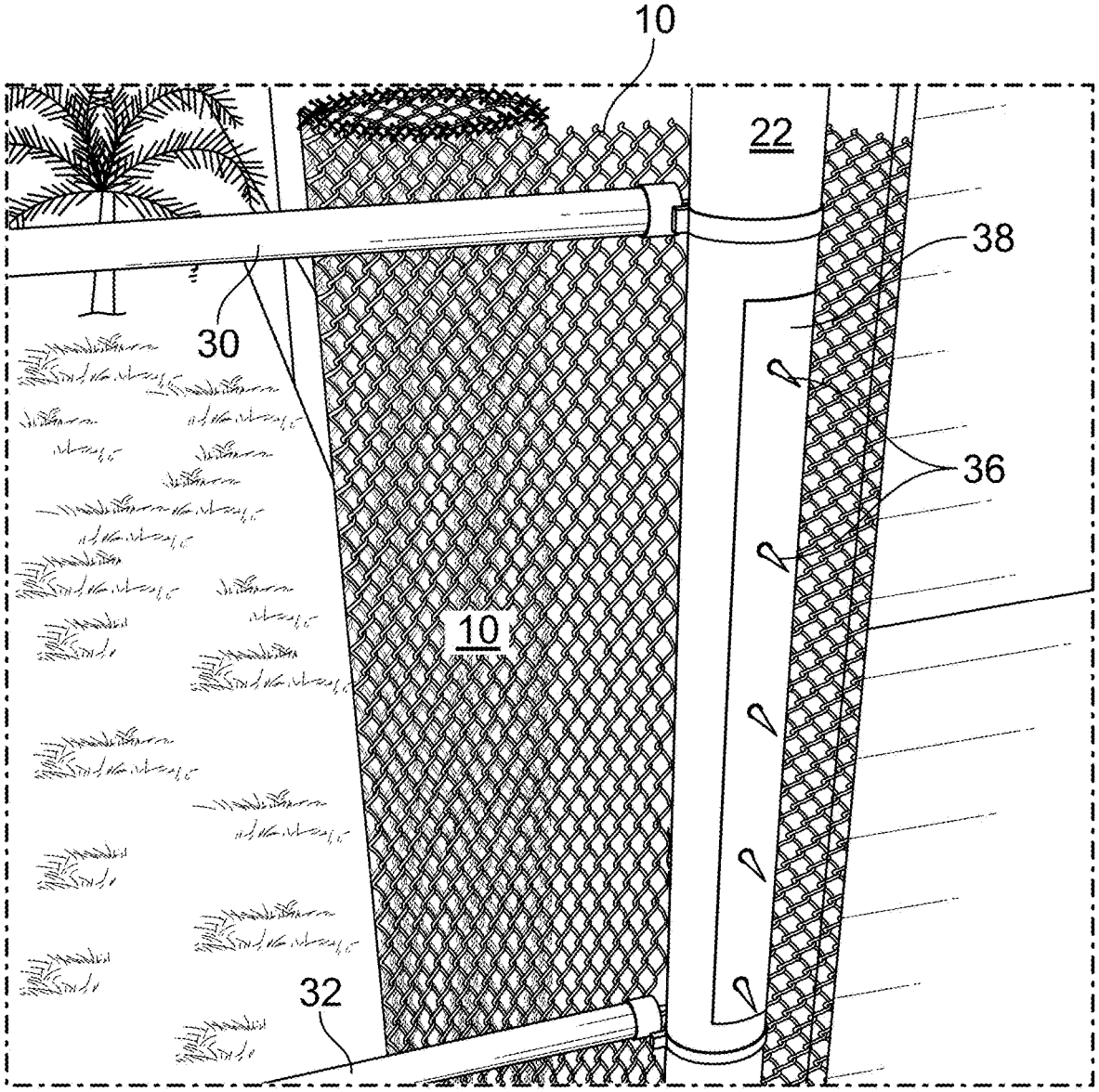
FIG. 7 is an enhanced view of the terminal post and grab bars welded to it.
Figure 8:
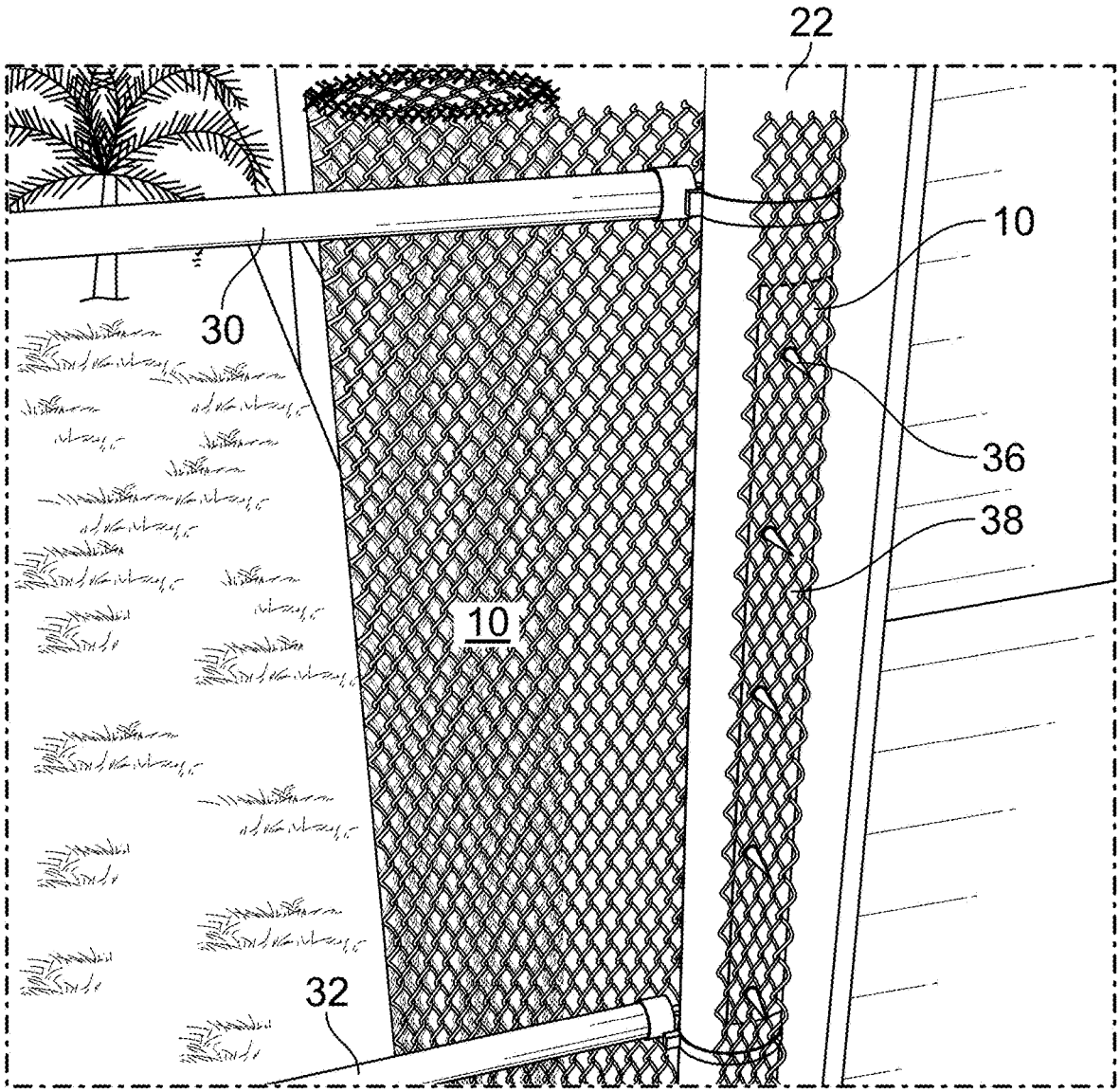
FIG. 8 is an enhanced view of the terminal post with the chain link mesh weave stretched over the high shear/strength aircraft rivets.
Figure 9:
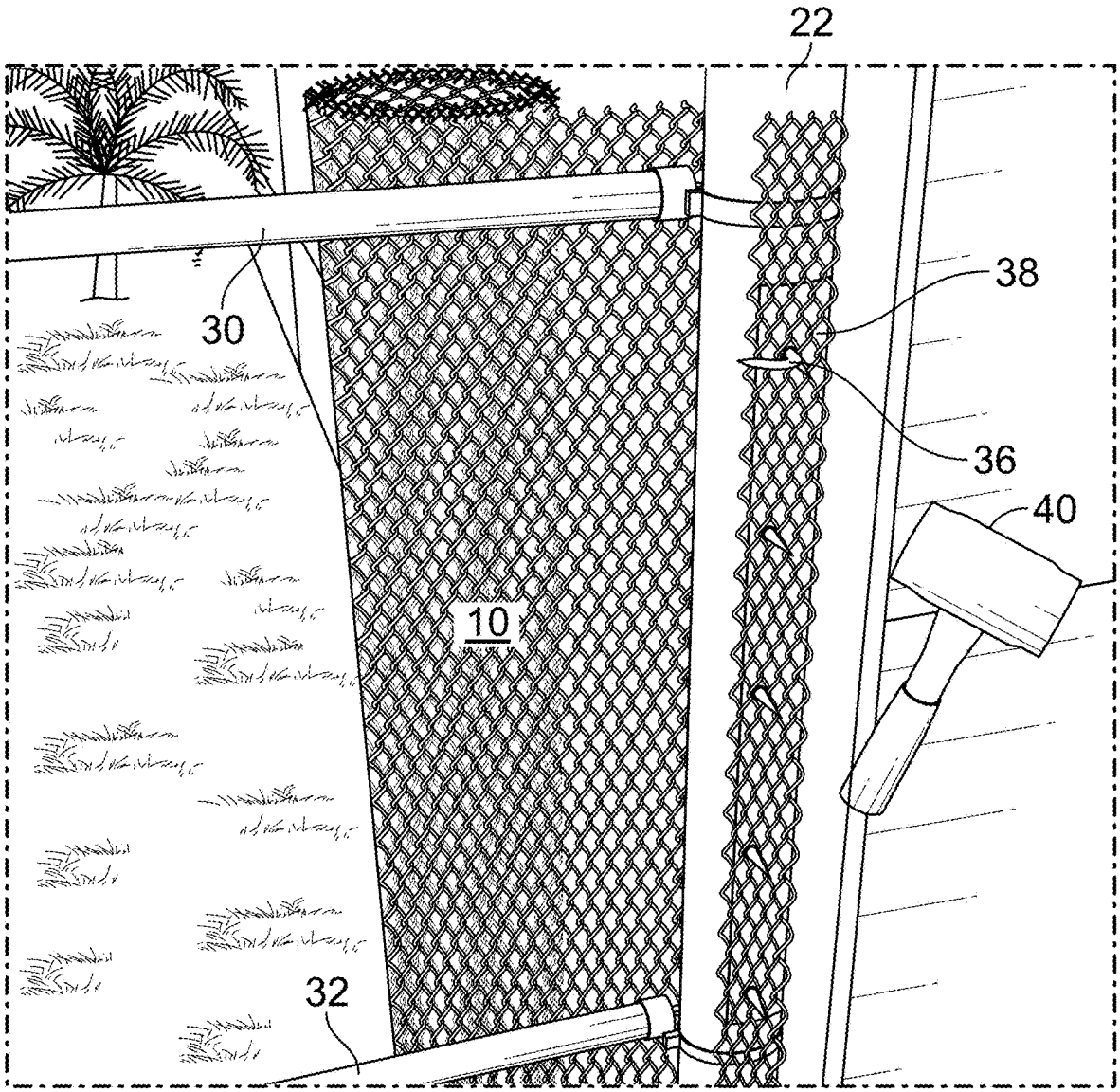
FIG. 9 is an enhanced view showing the chain link mesh weave being secured to the high shear/strength aircraft rivets on the welded proprietary grab bars.
Figure 10:
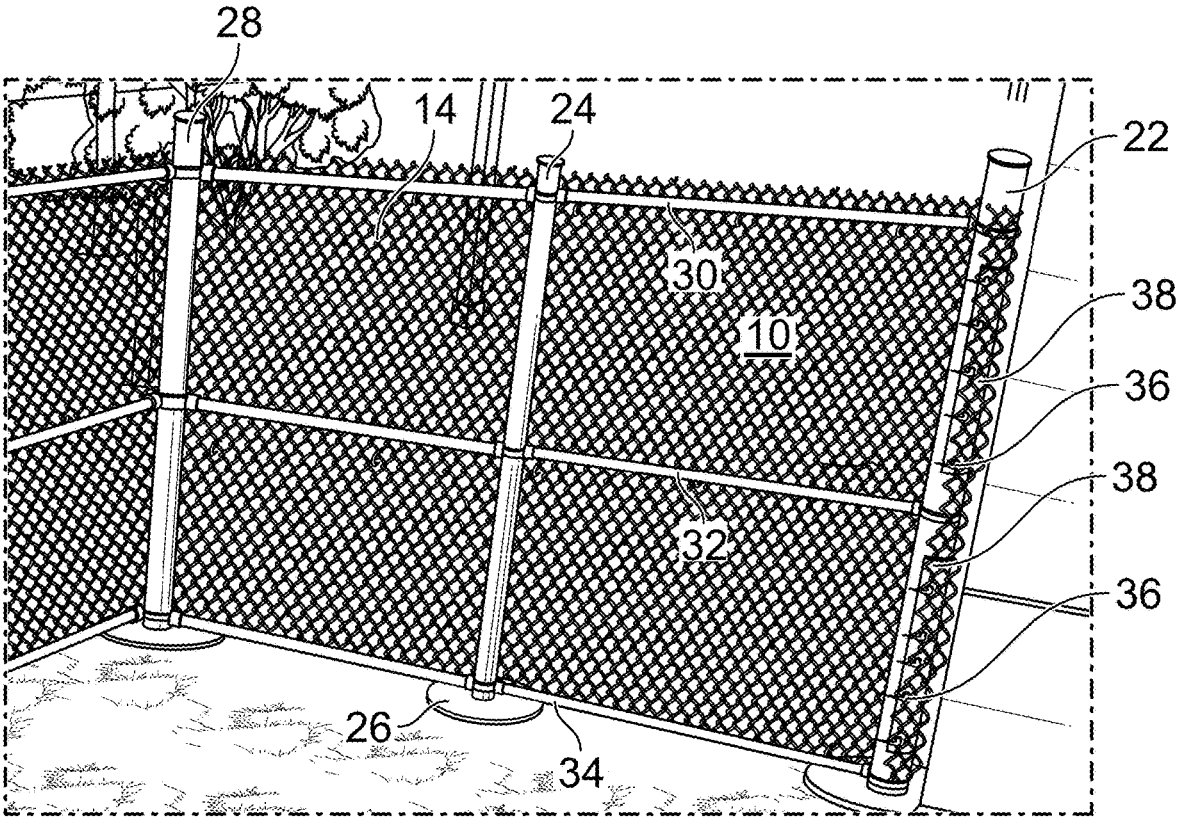
FIG. 10 is a perspective view of the perimeter fence, showing the chain link weave stretched across the framework of the line posts and rails.

It will be understood that in the assembly of the barrier 14 The chain link weave face, or mesh, 10 or 12 is wrapped around the starting terminal pole 22 as one seamless piece of mesh 10, 12 and attached to rivets 26 on grab bar 28 on first terminal pole 28, on the secure side of the barrier 14. The placement of the means to hold mesh 10, 12 to the barrier 14, eliminates the need for any mechanical fasteners typically used in or on fences, thereby increasing the security of barriers 14, as shown in FIGS. 7-9 as the barrier cannot be disassembled by persons seeking unauthorized entry or exit. The mesh 10, 12 is secured to the proprietary grab 28 bar via the high shear/strength aircraft rivets 26 as they are folded, or knocked, over and onto the mesh 10, 12 to secure the mesh thereto. Placement of the grab bar 28 on the interior side of the perimeter and wrapping the mesh around pole 28 both protects the fence from disassembly and provides a secure, fixed, element onto which the mesh can be wrapped and subsequently tensioned, as will be described below. The corners of the high shear/strength aircraft rivets, like the terminal poles or posts, are hammered down, using, for example, a mallet, to maximize security, as seen in FIG. 9.

Figure 11:
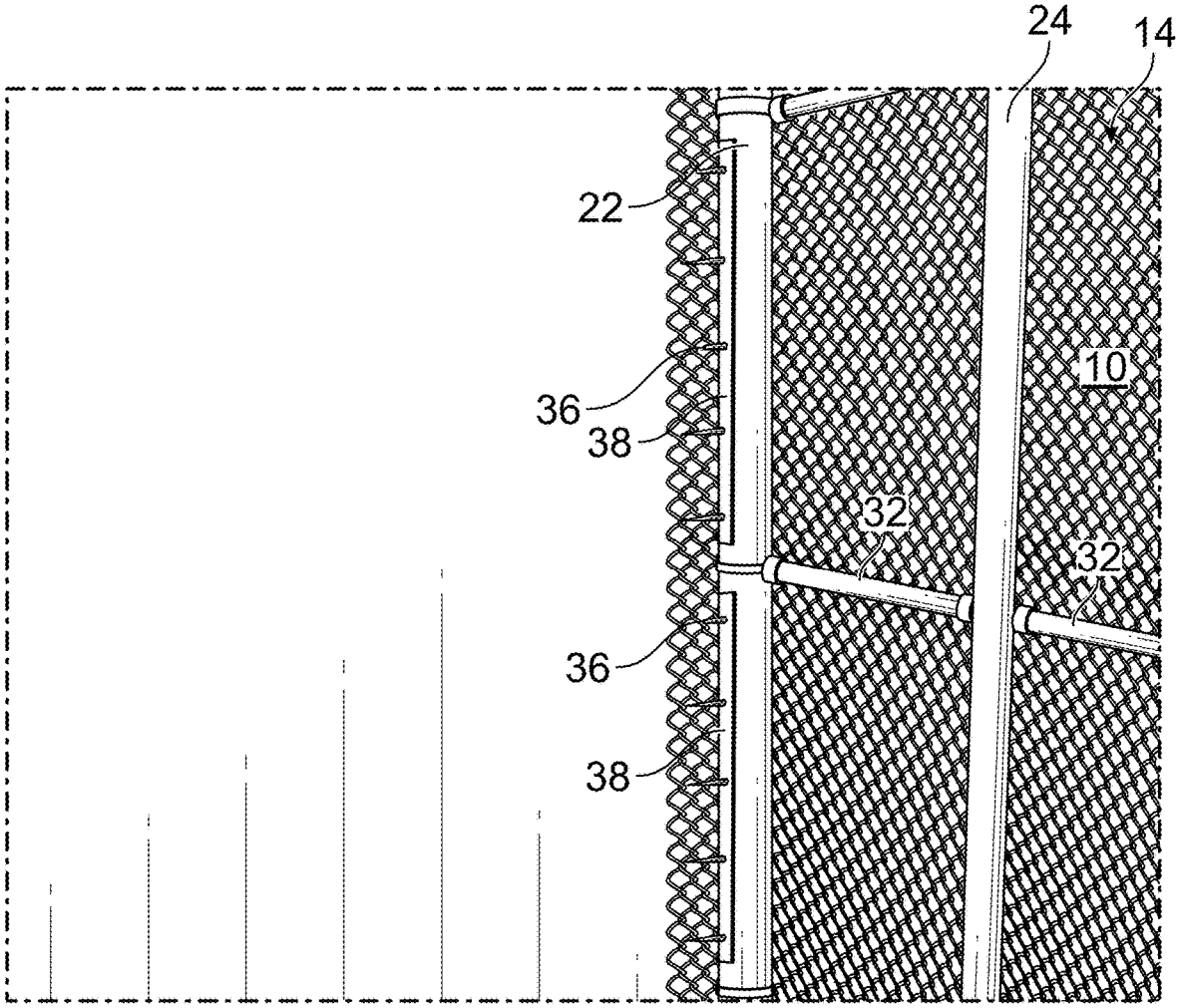
FIG. 11 is a view of the end terminal post with the grab bars welded to the terminal post.
Figure 12:
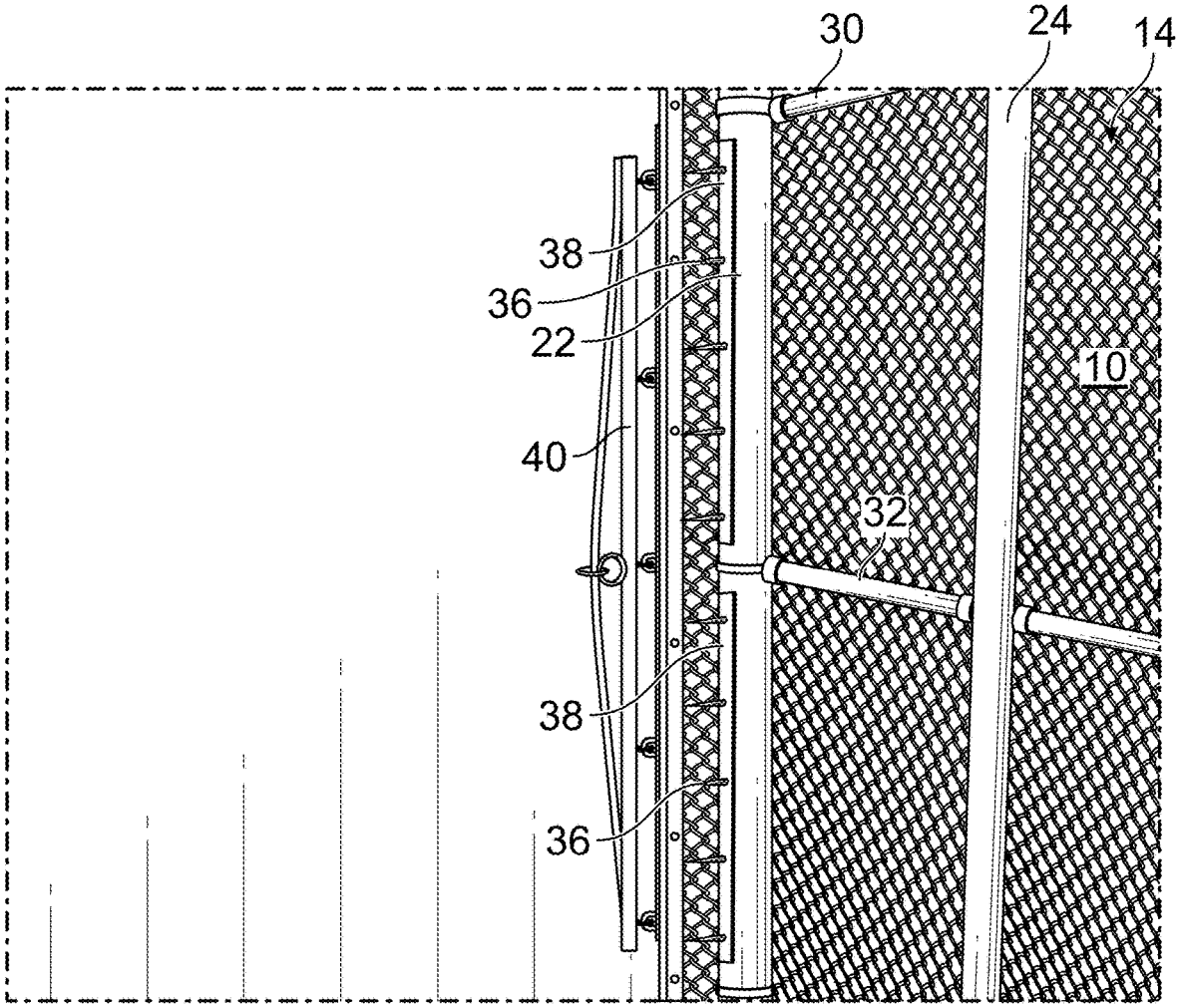
FIG. 12 is a view of the terminal post with the chain link mesh weave stretched over the line post framework with a tension bar affixed to the chain link mesh weave.

Once the chain link mesh 10, 12 is secured to a first terminal pole 22, the mesh 10, 12 is wrapped about the perimeter and end poles, 22, 24, and finally about second terminal pole 26*m* where it is tensioned at the ending terminal 2, as illustrated in FIGS. 11-13 and described herein, and then attached to rivets 36 on grab bar 38, affixed to second terminal pole 22.

Figure 15:
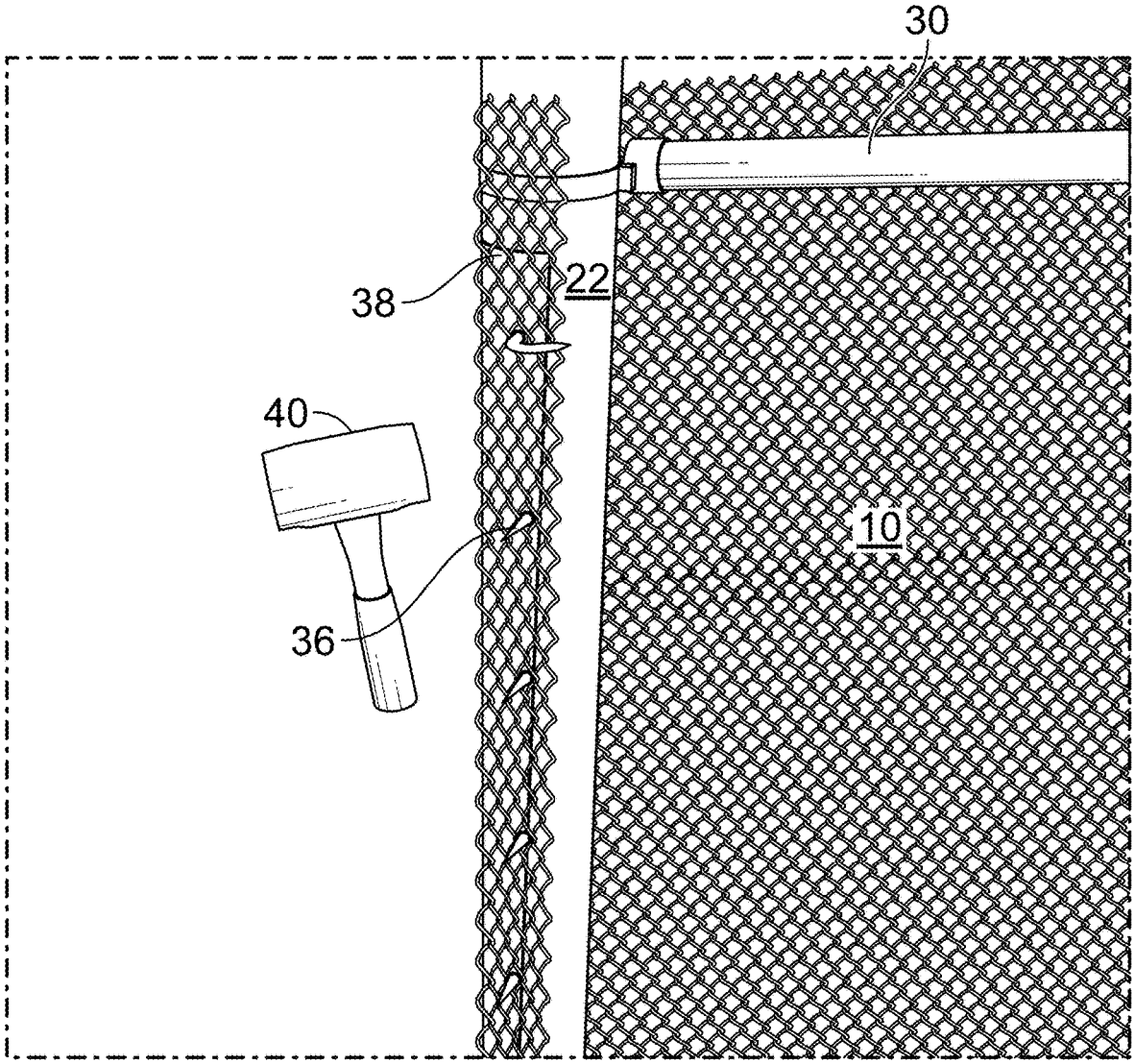
FIG. 15 is an exploded view of the terminal post with the end of the chain link weave pulled taught over the high shear/strength aircraft rivets.

As is illustrated in FIG. 12, a stretch bar or tension bar 40 is affixed to the end of the single roll of chain link mesh 10, 12. This tension bar 40 is connected to a fence tensioning tool 41, such as a come-a-long or pulley system, and tightened to the designed wind load specification desired, FIGS. 13-14. The mesh 10, 12 is wrapped over the ending terminal pole 22 and secured to the high shear/strength aircraft rivets 26, FIG. 15. A mallet 40, or similar tool, is then used to secure the mesh 10, 12 to the terminal pole 22 by folding over the high shear/strength aircraft rivets 26, holding the mesh 10, 12 therewithin.

Figure 16:
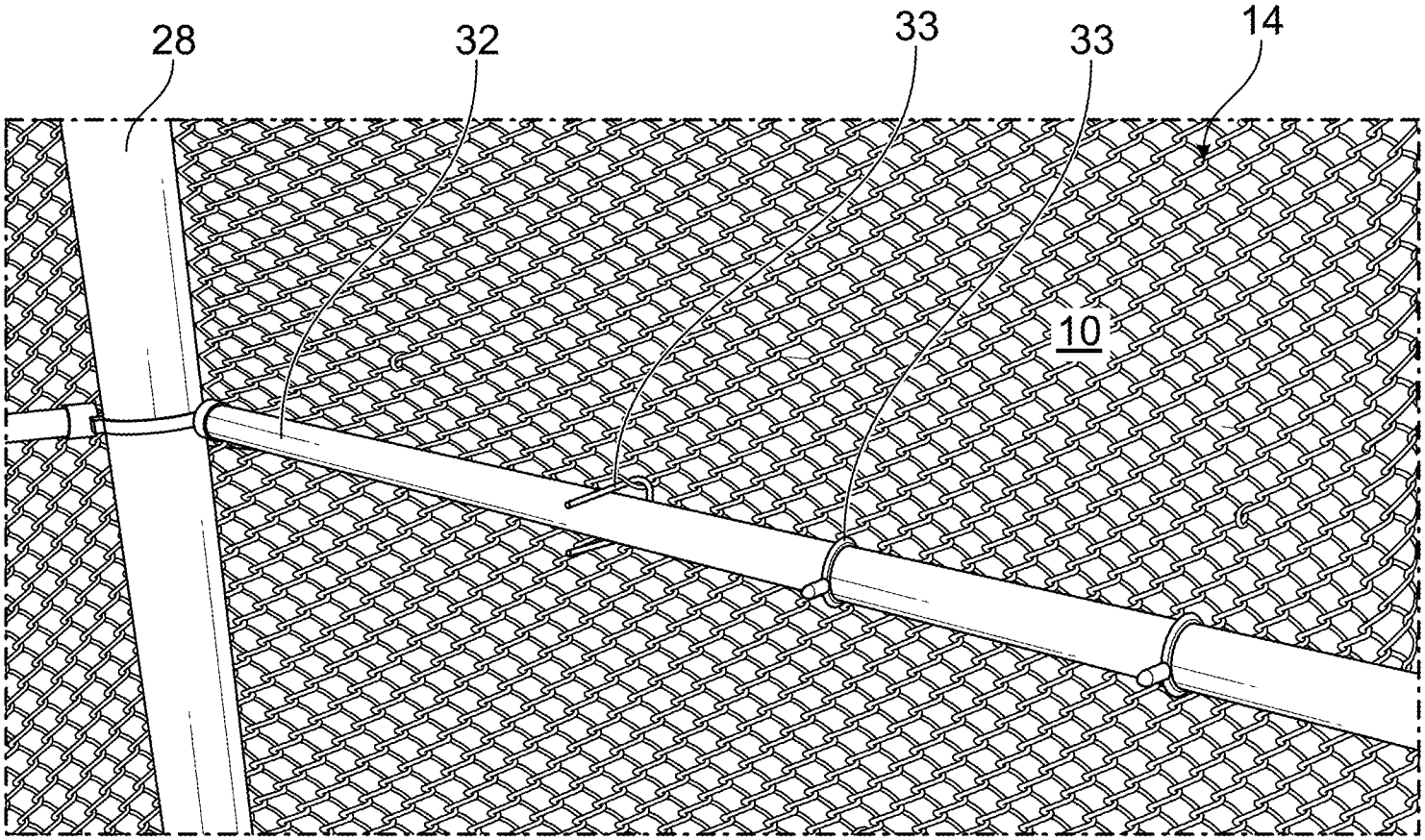
FIG. 16 is a perspective view of the chain link weave fastened to the middle rail bar.

Once the mesh 10, 12 is secured to terminal pole 22, metal ties 33 can be affixed to the middle rail bar 32, or any of the rail bars 30, 32 and 34 as desired or needed, to provide additional stability and security to the fence perimeter 14, FIG. 16.

Figure 17:
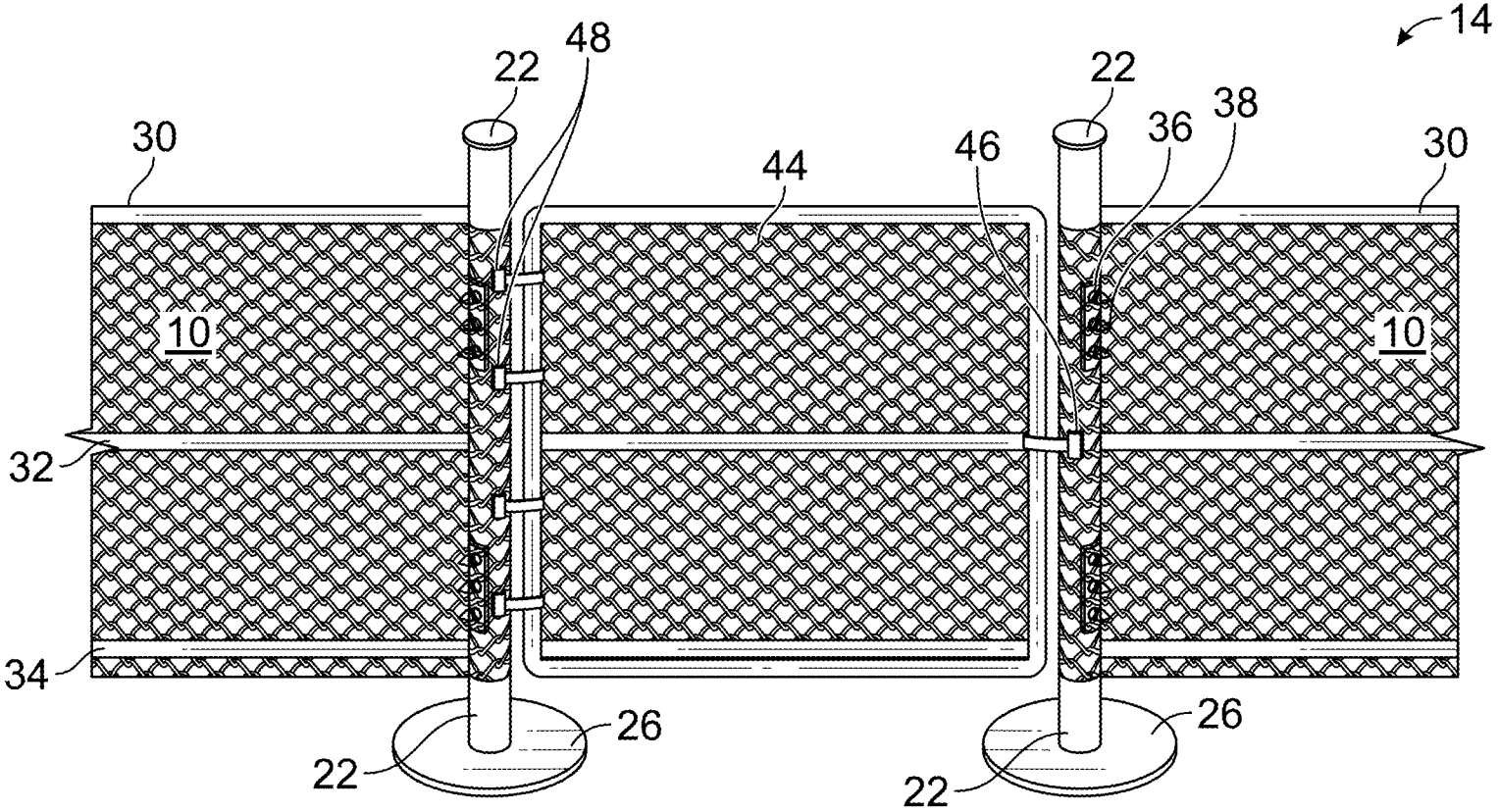
FIG. 17 is an elevational view of one manner of providing an opening is a barrier of the present invention.

Additionally, as will understood by persons having ordinary skill in the art, such a barrier 14 can include traditional means to deter climbing, including barbed wire, razor wire, electrification, surveillance cameras, drone stations, sentry posts and others, without departing from the novel scope of the present invention. Further, an opening can be included in a perimeter made entirely of the barrier 14 of the present invention, as illustrated in FIG. 17. As illustrated, the terminal poles 22 of a barrier 14 can be placed close to each other, the distance of the width of a gate 44, with the barrier 14 being constructed in the manner noted above; it will be seen that the terminal poles 22 comprise grab bars 36 with rivets 38 and that mesh 10 is wrapped about terminal posts 22, away from gate 44, in a manner that wraps the mesh 10 about poles 22 so as to allow tensioning as described above and to provide a secure wrap of poles 22. Mesh 10 is then wrapped, in the manner described above, about all of the pole elements of the barrier 14 and then back to the second terminal post 22, where it is tensioned and affixed to rivets 38 of grab bar 26 and affixed thereto, in the manner described above. Gate 44 can be attached to poles 22 in a manner known to persons having ordinary skill in the art (including affixing hinges 48 to first terminal pole 22 prior to the attachment of mesh 10 and hanging gate 44 thereto). A latch 46 of any type desired, and known in the art, can be used to then provide a locking mechanism for barrier 14. A simple method of lock is illustrated herein, it will be understood by persons having ordinary skill in the art, that high tech locking mechanisms are available and can be used in a gate 44 of the type illustrated, without departing from the novel scope of the present invention.

Persons having ordinary skill in the art will understand that an enhanced security fence 14 can take many shapes and styles. Disclosure of alternative embodiments of such fences is shown through the different mesh 10, 12 identified in FIGS. 1-2. It being understood that elements of one type fence shown in one figure could be used in other fences shown in the other figures, without departing from the novel scope of the invention.

By decreasing the number of parts and removing the use of typical industry components, the present invention is significantly improving industry standards regarding security, efficiency of installation and reduces added expense for parts not required. Furthermore, having additional parts such as the typical fencing components, a security fence becomes vulnerable to installation errors. All of these typical fencing components require more precision during installation because of a lower installation clearance between the components. Thereby not efficiently expending manpower during site installations. As stated previously, the present invention significantly minimizes the precision required during site installations. Thereby effectively and efficiently using manpower to install more units per day. Overall, the present invention further enhances security and expedites installation in comparison to other products available on the market, which is the main interest of a consumer for this type of product.

Specific embodiments of novel methods and apparatus for construction of the Chain Link Wrap or Mesh Fence with Grab Bars according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

What is claimed:

1. A secure tensioned perimeter barrier comprising:

at least two poles, each pole being affixed to a surface to be protected;

a length of metal chain link mesh;

a first grab bar affixed to a first pole of the at least two poles and a second grab bar affixed to a second pole of the at least two poles, each grab bar comprising a plate directly secured to an outer surface of its respective pole, each grab bar comprising a plurality of deformable holding means extending laterally from the plate that catch within openings of the metal chain link mesh;

a tensioning device;

wherein a first end of the metal chain link mesh is wrapped about the first pole, and held by the holding means of the first grab bar, the mesh being pulled tightly using the first pole, and any intervening pole, as a fulcrum, and tensioned with the tensioning device, and a second end of the metal chain link mesh, in a tensioned state, being wrapped about the second pole, and being held by the holding means of the second grab bar, thus forming the barrier.

2. The secure tensioned perimeter barrier of claim 1, wherein the holding means of each grab bar include extended metal rods.

3. The secure tensioned perimeter barrier of claim 1, wherein the holding means of each grab bar are rivets.

4. The secure tensioned perimeter barrier of claim 1, wherein the metal chain link mesh is one of a 9-gauge, ⅜" mesh weave, and a 6-gauge, ⅝" mesh weave.

5. The secure tensioned perimeter barrier of claim 1, wherein the first pole and second pole are terminal poles, the at least two poles further comprising a plurality of line poles and a plurality of corner poles;

the terminal poles, the line poles, and the corner poles all being affixed to the surface to form a protected perimeter.

6. The secure tensioned perimeter barrier of claim 5, wherein a plurality of generally horizontal bars are affixed between each of the terminal poles, line poles and corner poles.

7. The secure tensioned perimeter barrier of claim 6, wherein the length of tensioned metal chain link mesh is affixed to the plurality of generally horizontal bars using ties.

8. The secure tensioned perimeter barrier of claim 1, wherein the length of metal chain link mesh is sufficient to span from the first pole to the second pole, while fully encompassing any intervening poles positioned between the first pole and the second pole within the length of metal chain link mesh.

9. A method of making a secure tensioned perimeter barrier including the steps of:

providing a plurality of poles, a length of metal chain link mesh and at least two grab bars;

wherein each grab bar comprises a plate and a plurality of deformable holding means extending laterally from the plate;

providing a tensioning device;

directly securing the plate of each grab bar to outer surfaces of two of the plurality of poles, respectively, to create a first terminal pole and a second terminal pole;

affixing the plurality of poles to a surface to be protected;

attaching a proximal end of the length of metal chain link mesh to the holding means of the first terminal pole;

wrapping the length of metal chain link mesh about the first terminal pole to partially encase the first terminal pole with the metal chain link mesh and extending the length of mesh away from the first terminal pole and about each of the plurality of poles and to the second terminal pole where the mesh is terminated;

drawing on a distal end of the length of metal chain link mesh with the tensioning device, using the first pole as a fulcrum in the tensioning of the metal chain link mesh, to provide tension therewith the metal chain link mesh, wrapping the distal end of the metal chain link mesh about the second terminal pole to partially encase the second terminal pole therewithin the metal chain link mesh and instantly attaching the distal end of the length of metal chain link mesh to the holding means of the second terminal pole.

10. The method of making a secure tensioned perimeter barrier of claim 9, wherein the plurality of poles include the first and second terminal poles, corner poles and line poles.

11. The method of making a secure tensioned perimeter barrier of claim 9, wherein a plurality of horizontal bars are affixed between each pole of the plurality of poles, the plurality of horizontal bars being tied to the metal chain link mesh.

12. The method of making a secure tensioned perimeter barrier of claim 9, wherein the plurality of poles include the first and second terminal poles, two corner poles and a plurality of line poles generally spaced between the corner poles.

13. The method of making a secure tensioned perimeter barrier of claim 12, wherein the first and second terminal poles are configured to be placed adjacent a building structure.

14. The method of making a secure tensioned perimeter barrier of claim 9, wherein the plurality of poles are affixed to the surface and spaced apart, thus defining a perimeter on the surface to be protected.

15. The method of making a secure tensioned perimeter barrier of claim 14, wherein the plurality of poles include the first and second terminal poles, corner poles and line poles.

16. The method of making a secure tensioned perimeter barrier of claim 9, wherein the metal chain link mesh is one of a 9-gauge, ⅜" mesh weave, and a 6-gauge, ⅝" mesh weave.

17. The method of making a secure tensioned perimeter barrier of claim 9, wherein the holding means of each grab bar are metal rods, the metal rods being adapted to catch openings in the metal chain link mesh to instantly hold the metal chain link mesh thereon.

18. The method of making a secure tensioned perimeter barrier of claim 17, wherein when the metal chain link mesh is caught by the metal rods, the metal rods are then forcibly bent against the mesh, such that the metal chain link mesh is fixedly retained thereon.

* * * * *